United States Patent [19]

Tams

[11] Patent Number: 4,574,405

[45] Date of Patent: Mar. 11, 1986

[54] WATER LEVEL CONTROL DEVICE

[76] Inventor: Joseph Tams, 23016 Jacobson Rd., Brooksville, Fla. 33512

[21] Appl. No.: 604,287

[22] Filed: Apr. 26, 1984

[51] Int. Cl.[4] ..... E04H 3/18

[52] U.S. Cl. ..... 4/508; 4/507; 137/428; 137/434

[58] Field of Search ..... 4/508, 507; 73/322.5; 137/434, 435, 448, 428, 426

[56] References Cited

U.S. PATENT DOCUMENTS

| | | | |
|---|---|---|---|
| 2,809,752 | 10/1957 | Leslie | 4/508 X |
| 3,176,707 | 4/1965 | Wilson | 73/322.5 X |
| 3,270,770 | 9/1966 | Wilson | 73/322.5 X |
| 3,908,206 | 9/1975 | Grewing | 4/508 |
| 3,997,925 | 12/1976 | Hough | 4/508 |
| 4,265,598 | 5/1981 | Brand | 4/508 X |
| 4,342,125 | 8/1982 | Hodge | 4/508 |

*Primary Examiner*—Henry K. Artis

*Attorney, Agent, or Firm*—Sughrue, Mion, Zinn, Macpeak, and Seas

[57] ABSTRACT

A water level control device is adapted to be detachably mounted within a swimming pool at the desired water level. A float controlled valve is mounted within the housing which is responsive to changes in the water level of the swimming pool and which is provided with a water inlet and outlet located outside of the housing so as to prevent turbulence within the housing. A suitable air vent is provided adjacent the top of the housing above the water line and restricted water inlet apertures are provided adjacent the bottom of the housing below the water level to maintain the water level within the housing at the same level as the water level in the pool.

4 Claims, 7 Drawing Figures

FIG. 1
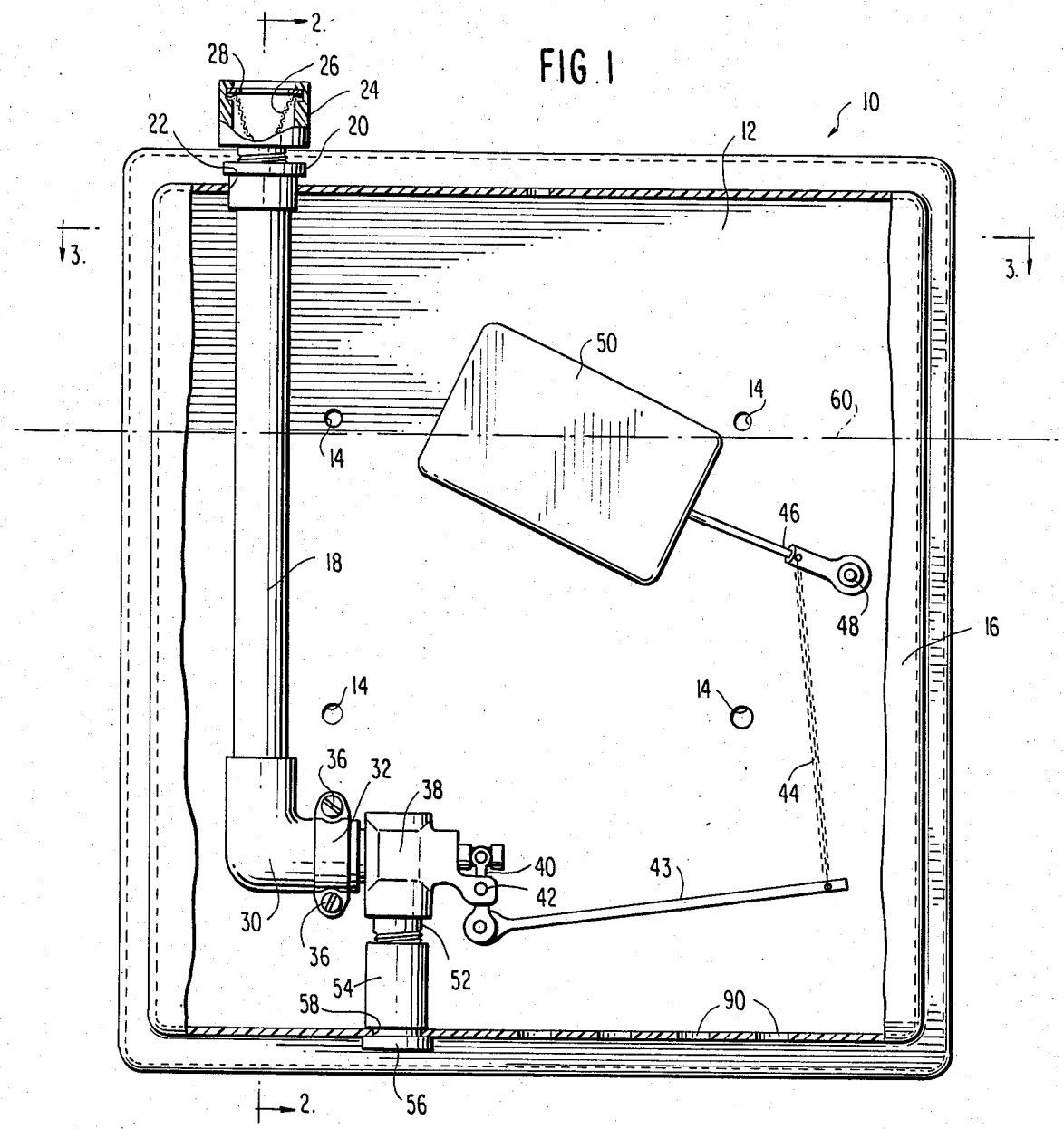
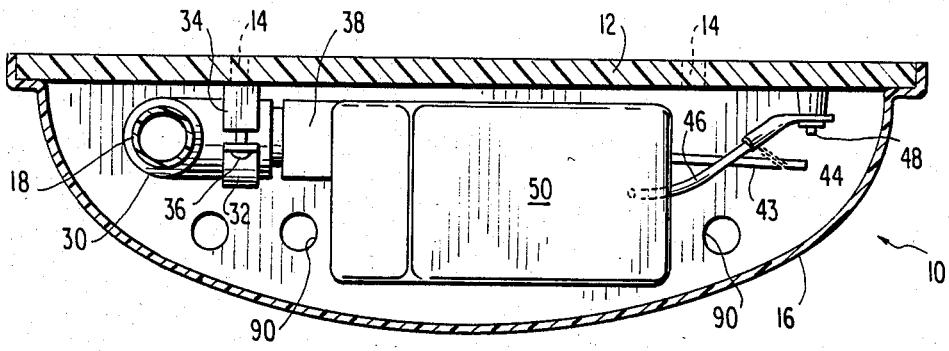
FIG. 3

FIG. 2
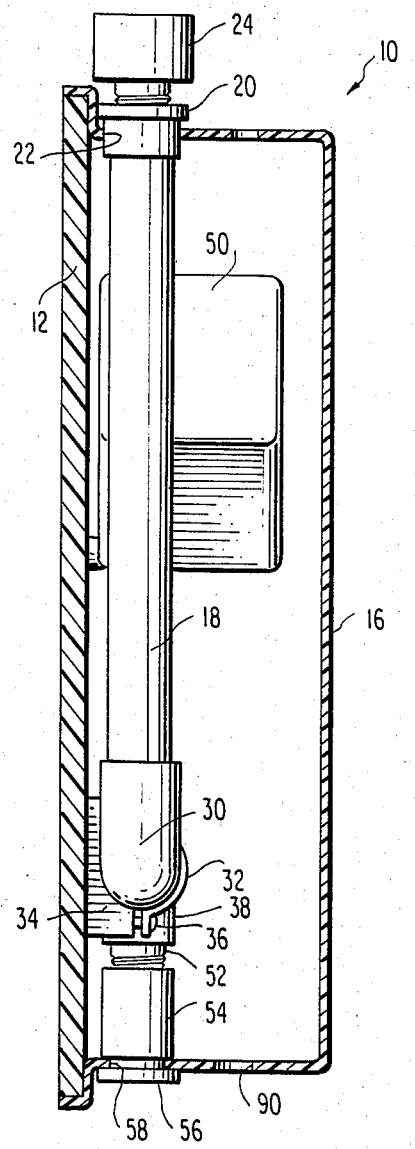
FIG. 4
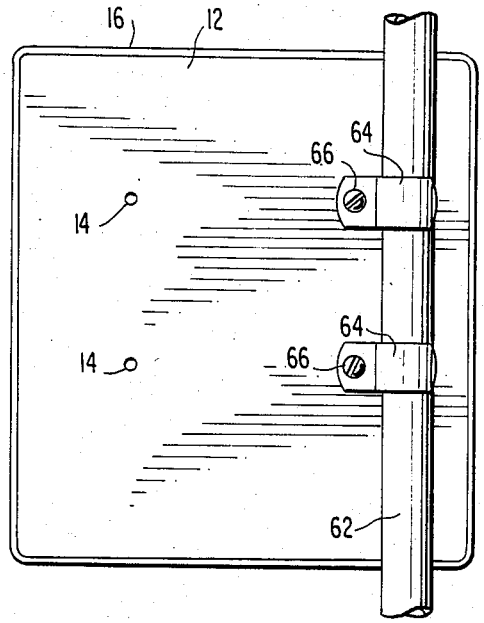
FIG. 5
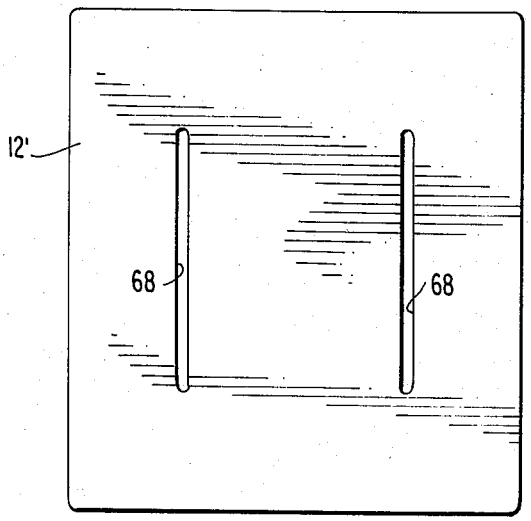
FIG. 6
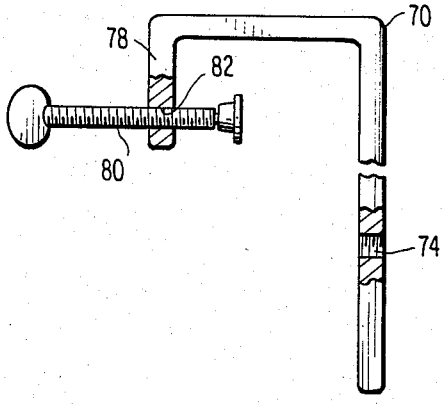
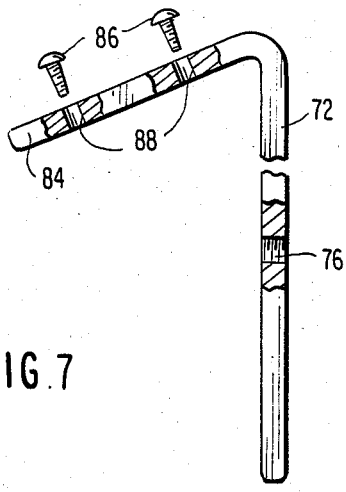
FIG. 7

WATER LEVEL CONTROL DEVICE

BACKGROUND OF THE INVENTION

The present invention is directed to a water level control device for a swimming pool and more specifically to a water level control device having a float control valve disposed in an apertured housing adapted to be mounted in a swimming pool at the desired water level with the outlet of the valve communicating directly with the swimming pool exteriorly of said housing.

In swimming pools of the type having a pool water circulation system wherein the surface water may be withdrawn through openings in the side of the pool, it is necessary to maintain a water level sufficient to insure a continuous supply of water to the circulation system in order to prevent damage to the circulation equipment. When a pool is left unattended for an extended period of time, especially in a very warm climate, the evaporation of water can cause a significant lowering of the water level. Should the water level drop below the openings in the side of the pool, the water pump for the circulation system could be burned out. The water level could also be substantially lowered due to leaks in the pool or due to extensive splashing of water out of the pool.

The use of water level control devices for maintaining a desired water level in a swimming pool is old and well known in the art. However, most of these water level control systems are extremely complicated and involve elaborate external float chambers and extensive built in plumbing, such as that disclosed in the Leslie U.S. Pat. No. 2,809,752, and the Grewing U.S. Pat. No. 3,908,206.

Another known type of water level control device utilizes a float control valve assembly disposed in a housing adapted to be mounted in a body of water adjacent the desired water level. Wilson U.S. Pat. No. 3,270,770, and Hodge U.S. Pat. No. 4,342,125, both disclose float control valve assemblies of this type wherein the outlet of the float control valve discharges water directly into the float chamber. As a result, the water level within the float chamber can be significantly different from the water level outside the float chamber and the turbulance of the water being discharged into the float chamber can adversely effect the accurate operation of the float operated valve assembly.

SUMMARY OF THE INVENTION

The present invention provides a new and improved water level control device which is simple in construction, economical to manufacture, and which overcomes the aforementioned difficulties associated with the prior art devices.

The present invention provides a new and improved water level control device comprising an apertured housing, means for detachably mounting said housing in a swimming pool adjacent the desired water level and float control valve means mounted in said housing, said float control valve means having water inlet means extending through said housing and adapted to be connected to an external water supply and water outlet means extending through said housing for discharging water from said valve means directly into the swimming pool.

The foregoing and other objects, features, and advantages of the invention will be apparent from the following more particular description of a preferred embodiment of the invention as illustrated in the accompanying drawings.

BRIEF DESCRIPTION OF THE DRAWINGS

FIG. 1 is a front view, partly in section, of the water level control device according to the present invention.

FIG. 2 is a sectional view taken along the line 2—2 of FIG. 1.

FIG. 3 is a sectional view taken along the line 3—3 of FIG. 1.

FIG. 4 is a rear view of the water level control device with the device mounted on a pool ladder.

FIG. 5 is a modified form of the mounting plate on the back of the device.

FIG. 6 is a side elevation view of an attachment bracket for securing the water level control device to a pool skim rail.

FIG. 7 is a side elevation view of another form of a support bracket adapted to mount the water level control device on the coping of a swimming pool.

DETAILED DESCRIPTION OF THE INVENTION

The water level control device 10, as shown in FIG. 1, is comprised of a substantially rectangular mounting plate 12 of plastic material or the like having four mounting holes 14 extending therethrough. A cover member 16 of plastic material is secured to the mounting plate 12 about the periphery thereof by any suitable means. The cover may be permanently secured by adhesives or the like, or may be detachably connected to the mounting plate by screws or the like. The cover member 16 extends in a smooth curve from one side of the mounting plate 12 to the opposite side as best seen in FIG. 3 so that automatic pool cleaning devices, such as skimmers, may be easily passed over the water level control device when the water level control device is mounted adjacent the side of the pool.

A water inlet pipe 18 is connected to an adapter 20 which extends through an aperture 22 in the upper surface of the cover 16 for securing the upper end of the inlet pipe 18 in a vertical position. A fitting 24 may be threadingly secured to the adapter 20 and is provided with a filter screen 26 and a washer 28 adajacent the inlet end thereof. The fitting is adapted to be connected to any suitable water supply means, such as a garden hose or the like. An elbow 30 is secured to the lower end of the inlet pipe 18, and is connected to the mounting plate 12 by means of the clamp 32 which is connected to a support block 34 by means of screws 36. The support block 34 may be of integral one piece construction with the mounting plate 12, or may be secured thereto by any suitable means.

A brass valve 38 is connected to the elbow 30 and is operated by means of a lever arm 40 pivotally connected to the valve body at 42. The lever 40 is adjustably connected to a lever arm 43 which in turn is connected by means of a chain 44 to a float supporting lever 46 which is pivoted on the mounting plate 12 by means of a pivot pin 48. A float member 50 is secured to the free end of the lever 46. The outlet 52 of the valve 38 has a sleeve 54 threaded thereon. An adapter 56 is secured to the opposite end of the sleeve 54 and is mounted in an aperture 58 in the bottom wall of the cover 16 so that water from the valve 38 is directed exteriorly of the housing.

In using the water level control device it is desirable to mount the device in a swimming pool with the water level disposed adjacent the line 60. A first mounting option for the device is shown in FIG. 4 wherein the mounting plate 12 is secured to a pool ladder 62 by means of pair of clamps 64 which are secured to the mounting plate 12 by means of screws 66. By having four holes 14 in the mounting plate 12 it is possible to have the water level control device 10 extend laterally from either side of the ladder.

FIG. 5 shows a modified mounting plate 12' having a pair of elongated parallel slots 68 formed therein. A water level control device with this type of mounting plate 12' is adapted to be secured to the edge of the pool by means of the brackets 70 or 72 as shown in FIGS. 6 and 7, respectively. The brackets 70 and 72 are provided with threaded holes 74 and 76 respectively through which a nut and bolt assembly (not shown) may pass in engagement with each slot 68 in order to vertically adjust the water level control device relative to the respective support bracket. The bracket 70 is designed for mounting the water level control device on the pool skim rail. The bracket 70 is provided with a spaced apart parallel leg 78 having a threaded clamping member 80 adjustably secured in a threaded aperture 82. The bracket 72 is especially adapted for mounting the water level control device along the edge of a swimming pool having a beveled coping along the edge thereof. The bracket 72 is provided with an angle plate 84 which is adapted to rest on the upper surface of the coping. The bracket 72 may be secured to the coping by means of screws 86 extending through apertures 88 in the plate 84.

In view of the wet environment in which the water level control device is mounted, it is preferable to construct the various elements from plastics material or other suitable corrosion resistent materials such as brass. The mounting plate 12 may be of fiber glass reinforced plastics material with the cover plate 16 being formed of a suitable molded plastics material. The float 50 may be of plastics material, such as polypropelene, while the pipe 18, the sleeve 54, the adapters 20 and 56, the fittings 24 and the elbow 30 may be of suitable PVC material. The clamps 32 and 64 may be of aluminum or brass, and the valve 38 may be of plastics material or brass. It is preferable that the lever arms 42 and 46 as well as the chain 44 be of brass material.

In the operation of the water level control device 10, it is only necessary to mount the device with the line 60 at the desired water level by using the adjustable mounting means shown in FIGS. 4–7. The water level control device is then connected to a suitable water supply by means of a hose or the like which may be connected to the fitting 24. The water within the pool may enter the housing through the restricted 90 located in the bottom of the cover 16 so that the water level in the device will be the same as the water level outside the device. When the water level drops the float 50 will move downwardly, thereby rotating the lever arm 46 in a counterclockwise direction. This will allow the clockwise rotation of the lever 42, thereby opening the valve 38 to allow water under pressure to enter the pool directly through the water outlet adapter 56. In this way there is no turbulence created within the housing to affect the operation of the float control valve.

While the invention has been particularly shown and described with reference to preferred embodiments thereof, it will be understood by those in the art that various changes in form and details may be made therein without departing from the spirit and scope of the invention.

I claim:

1. A water level control device comprising housing means, mounting means for adjustably and detachably mounting said housing means in a swimming pool adjacent the desired water level and float controlled valve means mounted in said housing means, said float controlled valve means having water inlet means extending outwardly of said housing means for connection to an external water supply and water outlet means extending outwardly of said housing means for discharging water from said valve means directly into the swimming pool to prevent turbulence within said housing means, said housing means having restricted water inlet apertures disposed adjacent the bottom of the housing means to provide for the flow of water into the housing means.

2. A water level control device as set forth in claim 1 wherein said housing means is comprised of a flat mounting plate having a plurality of apertures therein and a cover having a curved front wall extending from one side of said mounting plate to the other side thereof, and a top wall having vent means.

3. A water level control device as set forth in claim 2 wherein said mounting means are comprised of a pair of arcuate clamping plates adapted to engage the upright post of a pool leader and fastening means for securing arcuate clamping plates to said apertures in said mounting plate.

4. A water level control device as set forth in claim 2 wherein said apertures in said mounting plate are comprised of a pair of elongated vertically extending parallel slots and said mounting means are comprised of angled plate means adapted to extend over a horizontal edge of a swimming pool and first means for connecting said angled pipe means to said slots in said mounting plate and second mounting means for securing said angled plate means to said swimming pool structure.

* * * * *